US006681732B2

(12) United States Patent
Niethammer et al.

(10) Patent No.: US 6,681,732 B2
(45) Date of Patent: Jan. 27, 2004

(54) CONTROL DEVICE FOR SWITCHING INTAKE AND EXHAUST VALVES OF INTERNAL COMBUSTION ENGINES

(75) Inventors: Bernd Niethammer, Blythewood, SC (US); Ulrich Augustin, Regensburg (DE)

(73) Assignee: Hydraulik-Ring GmbH, Nürtingen (DE)

( * ) Notice: Subject to any disclaimer, the term of this patent is extended or adjusted under 35 U.S.C. 154(b) by 0 days.

(21) Appl. No.: 09/972,025

(22) Filed: Oct. 5, 2001

(65) Prior Publication Data

US 2002/0104495 A1 Aug. 8, 2002

(30) Foreign Application Priority Data

Oct. 7, 2000 (DE) ..... 100 49 698

(51) Int. Cl.[7] ..... F01L 9/02

(52) U.S. Cl. ..... 123/90.12; 123/90.11; 123/90.15; 251/30.01; 251/129.03

(58) Field of Search ..... 123/90.12–90.15, 123/90.11; 251/30.01, 129.03, 129.07, 129.09, 129.15

(56) References Cited

U.S. PATENT DOCUMENTS 5,022,358 A * 6/1991 Richeson ..... 123/90.12
5,224,683 A * 7/1993 Richeson ..... 251/30.01
5,248,123 A * 9/1993 Richeson et al. ..... 251/29
5,275,136 A * 1/1994 Schechter et al. ..... 123/90.12
5,339,777 A * 8/1994 Cannon ..... 123/90.12
5,638,781 A * 6/1997 Sturman ..... 123/90.12
5,960,753 A * 10/1999 Sturman ..... 123/90.12
6,067,946 A * 5/2000 Bunker et al. ..... 123/90.12
6,374,784 B1 * 4/2002 Tischer et al. ..... 123/90.12

* cited by examiner

*Primary Examiner*—Thomas Denion
*Assistant Examiner*—Kyle Riddle
(74) *Attorney, Agent, or Firm*—Gudrun E. Huckett

(57) ABSTRACT

A control device for switching an intake or exhaust valve of an internal combustion engine has a control valve with a control valve piston for controlling flow of a hydraulic medium from a pressure line to the intake or exhaust valve. At least one actuating element is correlated with the intake or exhaust valve and has a first end acted on by the hydraulic medium. At least one damping device interacts with the at least one actuating element and is arranged at a second end of the actuating element opposite the first end. The at least one damping device exerts a damping force onto the actuating element counteracting a force exerted by the hydraulic medium.

24 Claims, 10 Drawing Sheets

CONTROL DEVICE FOR SWITCHING INTAKE AND EXHAUST VALVES OF INTERNAL COMBUSTION ENGINES

BACKGROUND OF THE INVENTION

1. Field of the Invention

The invention relates to a control device for switching intake and exhaust valves of internal combustion engines, wherein the control device comprises a control valve with a control valve piston by which the supply of hydraulic medium from a pressure line to the intake or exhaust valve can be controlled.

2. Description of the Related Art

Camshafts are conventionally used for switching or controlling intake or exhaust valves of internal combustion engines. It is also known to hydraulically control the intake or exhaust valves. The hydraulic medium which is supplied by a pressure line is supplied via the control valve piston to the intake or exhaust valves which are then moved into the required position by the pressurized hydraulic medium.

SUMMARY OF THE INVENTION

It is an object of the present invention to configure the control device of the aforementioned kind such that the intake or exhaust valves can be adjusted optimally.

In accordance with the present invention, this is achieved in that the intake or exhaust valve has at least one actuating element which has at least one damping device at its side facing away from the hydraulic medium wherein the damping device counteracts the force exerted by the hydraulic medium onto the actuating element.

In the control device according to the present invention the hydraulic damping can be adjusted such that it conforms to the activation curve of the cam of a camshaft. In this way, it is possible to provide harmonic transitions, as they are known from camshafts, even for camshaft-free internal combustion engines in a simple way and with significant advantages in comparison to conventionally controlled engines.

DESCRIPTION OF THE PREFERRED EMBODIMENTS

Figure 1:
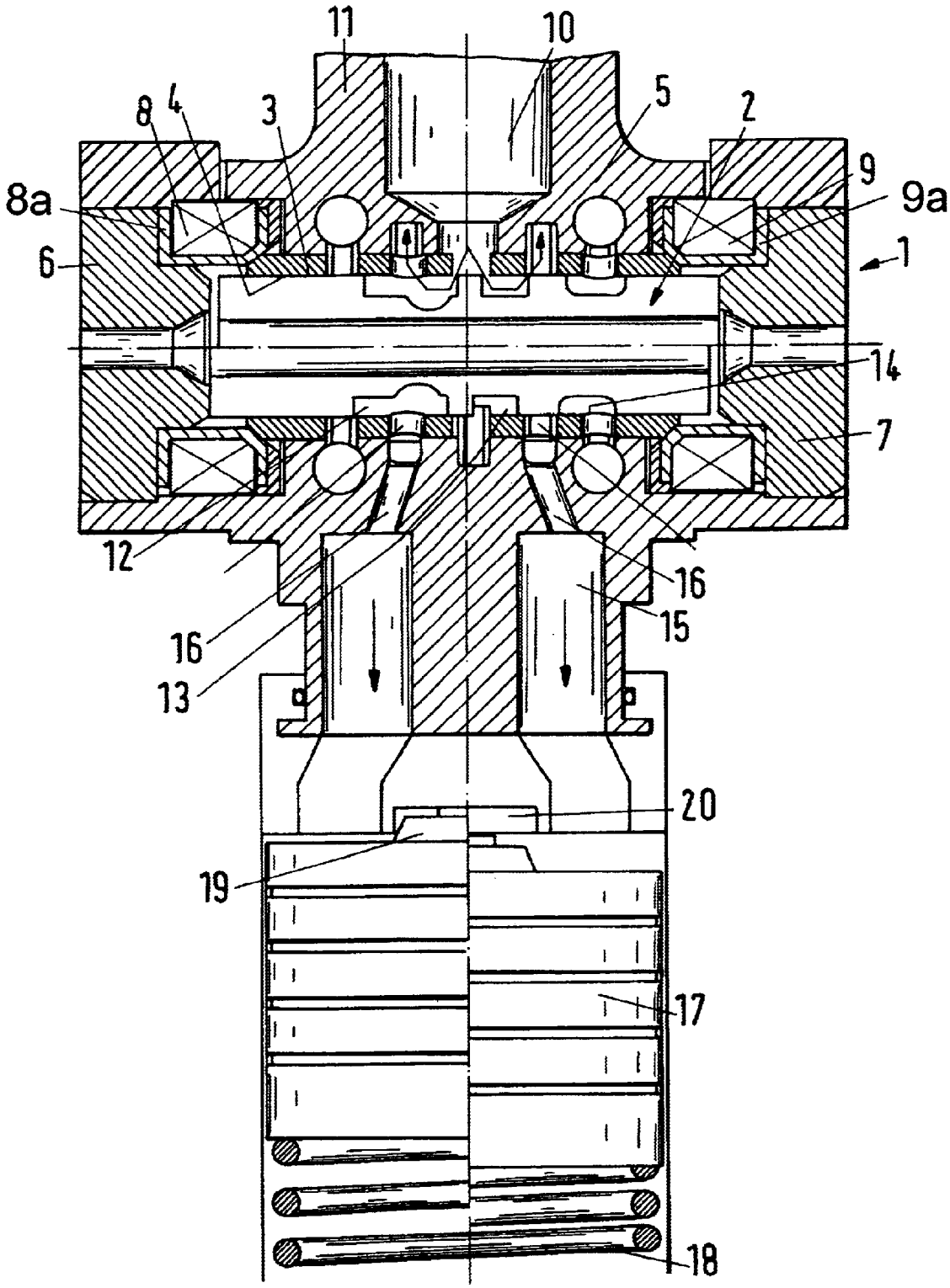
FIG. 1 is an axial section of a part of a first embodiment of the control device according to the invention.

The control device according to the invention is provided for switching or controlling intake valves and exhaust valves of internal combustion engines—preferably diesel engines—which have no camshaft. The control device has a control valve 1 which is provided with a control valve piston 2. In FIG. 1, the control valve piston 2 is shown in a first end position in the upper half of the drawing and in a second end position in the lower half of the drawing. The control valve piston 2 is axially slidably arranged in the bushing 3 which is pressed into a receptacle 4 of the valve housing 5. Both ends of the valve housing 5 are closed off by stops 6 and 7 against which the control valve piston 2 rests in the first and second end positions. The control valve piston 2 forms an armature which is moved in the desired direction by supplying current to or exciting the two coils 8 and 9. The two coils 8, 9 which are connected to a computer unit (not illustrated) are provided in the area of the stops 6 and 7, respectively. The two coils 8, 9 can be connected by welding to the valve housing 5 in the area where the ends of the control valve piston 2 are located (in the vicinity of the stops 6, 7) and have curlers 8*a*, 9*a* for this purpose.

The bushing 3 of the control valve 1 can also be eliminated so that a constructively simplified configuration results.

The bushing 3 has two tank connectors T as well as two work connectors A via which a hydraulic medium can be supplied from a pressure line 10 (pressure connector P). The pressure line 10 is a bore in a housing 11 which is preferably a monolithic part of the valve housing 5. The axis of the pressure line 10 is positioned perpendicularly to the piston axis of the piston 2.

The control valve piston 2 is provided with three annular grooves 12–14 positioned at an axial spacing to one another. Depending on the position of the control valve piston 2, the hydraulic medium can flow, coming from the pressure line 10, to the tank connector (relief bore) T or to the work connector A. On the side of the control valve 1 facing away from the pressure line 10 an annular pressure chamber 15 is provided into which bores 16 open which connect the work connectors A with the pressure chamber 15.

Figure 2:
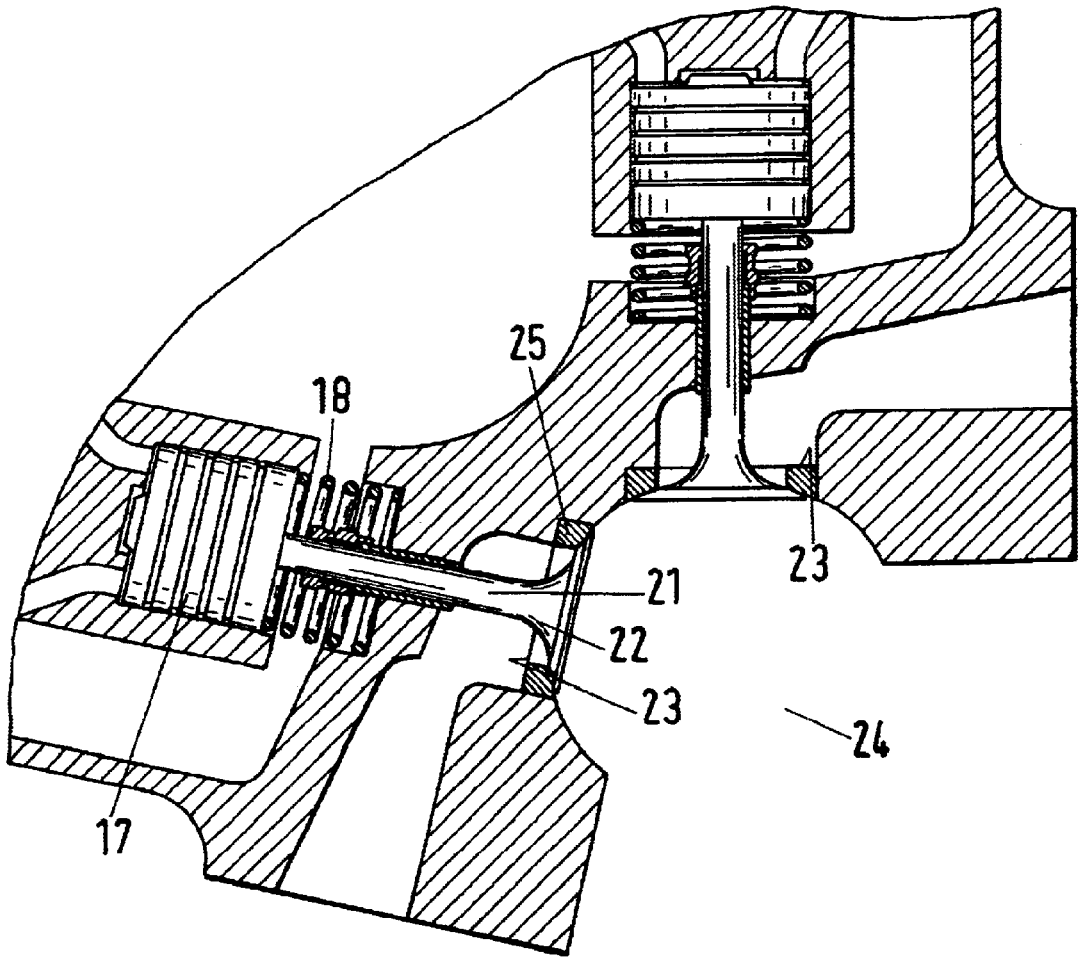
FIG. 2 is an axial section of a part of an internal combustion engine showing an intake valve and an exhaust valve.

By means of the pressurized hydraulic medium which flows through the annular pressure chamber 15, a bucket tappet 17 is moved against a counter force, preferably against the force of at least one coil pressure spring 18. The bucket tappet 17 has a central, axially extending projection 19 with which it engages the depression or recess 20 of the housing 11 under the force of the coil pressure spring 18. As is illustrated in FIG. 2, the bucket tappet 17 is provided with a valve shaft 21 which carries at its free end a valve disc 22 with which an intake/exhaust opening 23 opening into the combustion chamber 24 can be closed off. In the combustion chamber 24 the piston (not illustrated) of the internal combustion engine is arranged. The internal combustion engine has several such combustion chambers 24 with corresponding intake valves and exhaust valves. In FIG. 2 two such valves are illustrated in an exemplary fashion; they provide two intake/exhaust openings 23 that open or close as a function of the number of revolutions (revolutions per minute—rpm) of the crankshaft (not illustrated) of the engine. In a closed position, the valve disc 22 rests in a seal-tight way on the valve seat 25 under the force of the coil pressure spring 18.

In order to open the corresponding valve, the hydraulic medium, controlled by the computer unit, is supplied via the pressure line 10. The coil 9 is supplied with current (excited)—this being controlled also by the computer unit—so that the control valve piston 2 is moved into the end position illustrated in FIG. 1 in the upper half in which the control valve piston 2 rests against the stop 7. The hydraulic medium therefore can flow from the pressure line 10 via the work connectors A and the bores 16 into the annular pressure chamber 15. The hydraulic pressure is greater than the counter force exerted by the coil pressure spring 18 so that the bucket tappet 17 can be moved against this spring force and the opening 23 into the combustion chamber 24 is opened. Fuel can then be injected in the way known in the art into the combustion chamber 24. This injection process is also computer-controlled, as is known in the art. As soon as the injection step is complete, the other coil 8 is supplied with current (excited)—this being controlled also by the computer unit—so that the control valve piston 2 can be moved into the end position illustrated in the lower half of FIG. 1. In this position, the pressure line 10 is connected with the tank line (relief bore) T. Accordingly, the bucket tappet 17 is no longer loaded by the hydraulic medium but by the spring 18 and is returned into the initial position illustrated in FIG. 1 in which the valve disc 22 closes the opening 23.

In the described embodiment the triggering behavior of the intake/exhaust valves is controlled such that the hydraulic medium actuates through the control valve piston 2 of the control valve the bucket tappet 17 which, in turn, actuates the intake or exhaust valve and thus makes possible the gas exchange in the combustion chambers 24. The control valves 1 can be controlled in a variable way so that a high power utilization, i.e., an increased efficiency, can be obtained. Moreover, the exhaust emissions are considerably improved, in particular, the $NO_x$ output is reduced. This is based on the fact that the fuel/air ratio of the combustion mixture is adjusted optimally to the corresponding rpm (revolutions per minute) and load moment of the engine.

As a result of the hydraulic adjustment of the bucket tappet 17 acting as a hydraulic piston, a hydraulic damping of the bucket tappet 17 is possible which then corresponds to the activation curve of a cam. This enables the realization of harmonic transitions—as they are known from the camshafts—also for hydraulic control of the intake/exhaust valves without camshafts. As a result of the high damping, the motor noise is considerably reduced. The damping of the bucket tappet 17 is achieved (FIG. 10) in that the wall 26*a* of the receptacle 26 receiving the bucket tappet 17 has at least one opening 27 through which a damping medium, preferably lubricant oil, can be supplied.

Figure 10:
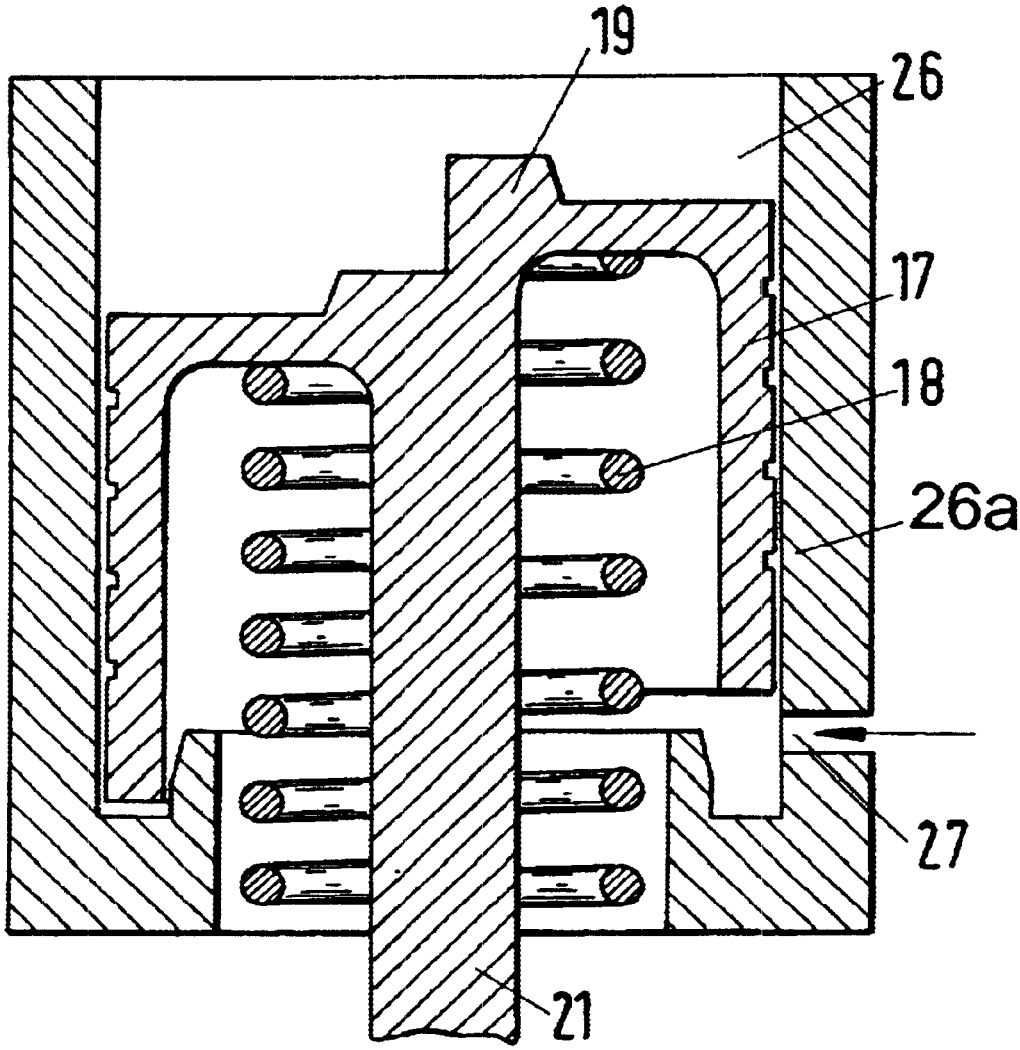
FIG. 10 shows the damping action of the control valve piston of the control device according to the invention.

In the left half of FIG. 10, the bucket tappet 17 is illustrated in its one end position into which it has been moved by the hydraulic medium coming from the annular pressure chamber 15 (FIG. 1) for opening the intake/exhaust valve. In this way, the damping medium present within the bucket tappet 17 is displaced through the opening 27 so that the movement of the bucket tappet 17 is dampened. In the right half of FIG. 10, the bucket tappet 17 is illustrated in its other end position into which it is moved by the spring 18 and in which its projection 19 rests against the bottom of the recess 20 (FIG. 1). In this end position, the bucket tappet 17 has been moved back so far that the opening 27 is unobstructed so that the damping medium can again reach the area underneath the bucket tappet 17 (FIG. 10).

The bucket tappet 17 can also be loaded by a hydraulic counter spring. In this case, the bucket tappet 17 is arranged between two hydraulic chambers. With this configuration, the system can be returned by means of an additional valve or an oil spring storage device.

Figure 3:
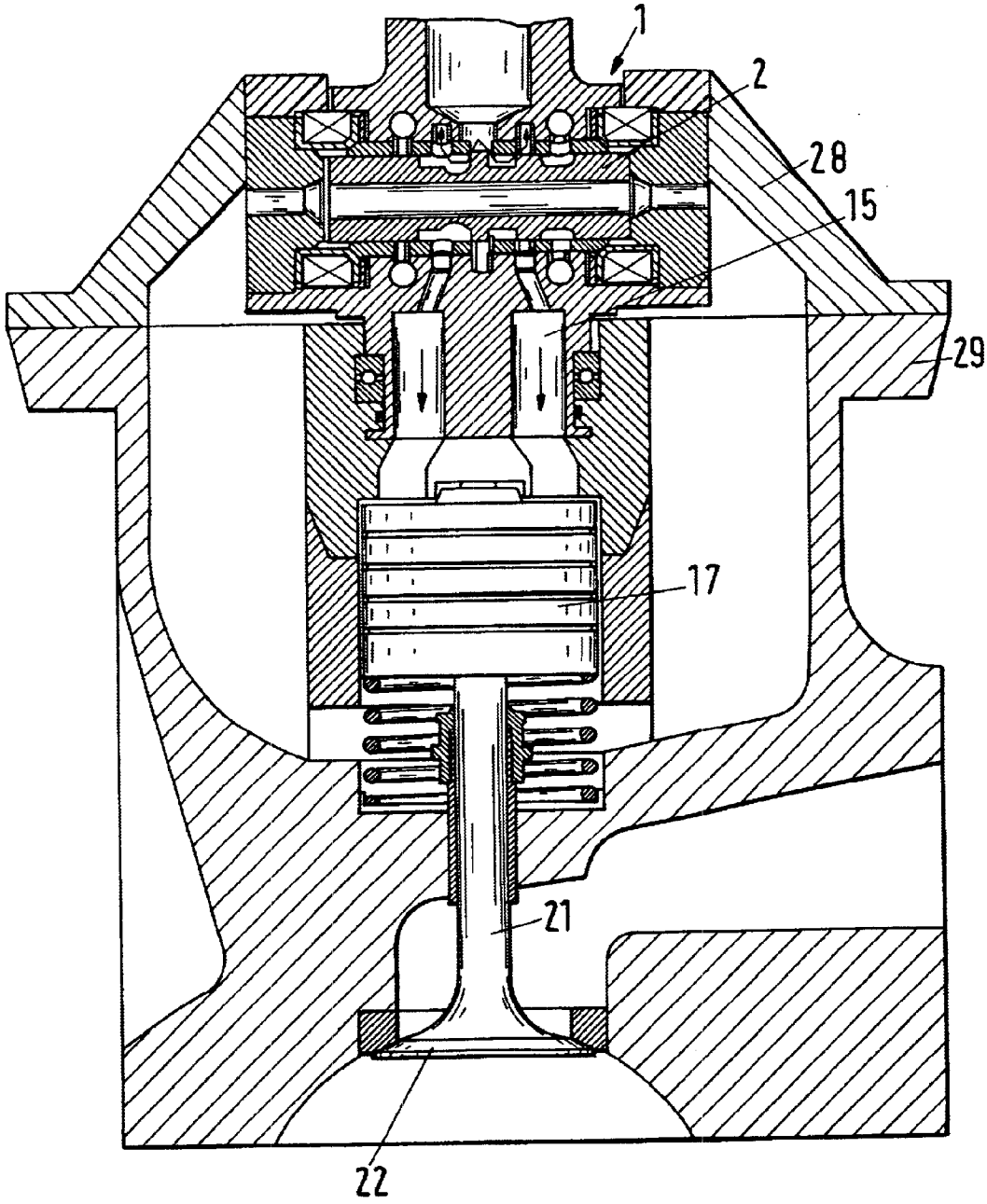
FIG. 3 shows the control device according to FIG. 1 in axial section.

The control valve 1 is arranged in a housing part 28 (FIG. 3) of the control device. The housing part 28 is mounted on an engine block 29 in which the different intake/exhaust valves with the corresponding bucket tappets 17, are arranged. The axis of the bucket tappet 17 is aligned with the axis of the valve shaft 21. The axis of the annular chamber 15, via which the hydraulic medium is supplied, is also aligned with the axis of the bucket tappet 17. The control valve 1 is positioned above the pressure chamber 15.

Figure 4:
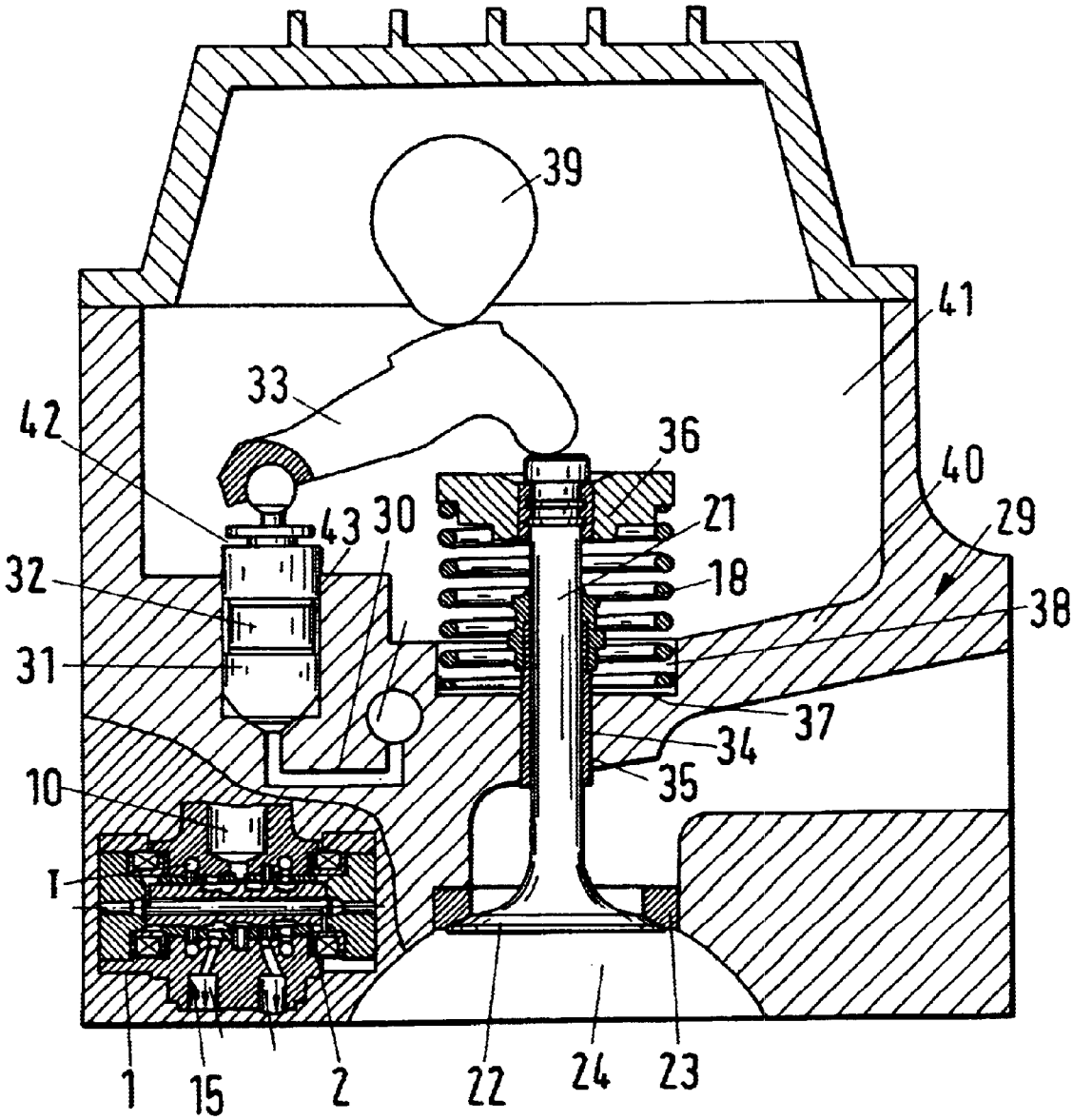
FIG. 4 is a second embodiment of the control device according to the invention.

FIG. 4 shows an embodiment in which the control valve 1 is arranged in the area adjacent to the intake/exhaust valve and which comprises a transmission unit 32, 33 for transmitting the movement of the control valve piston onto the intake/exhaust valve. The control valve 1 is configured identically to the embodiment according to FIGS. 1 through 3. Depending on the position of the control valve piston 2, the hydraulic medium supplied via the pressure line 10 reaches the tank connector T or the work connector A. The pressurized hydraulic medium within the pressure line 10 supplied to the pressure chamber 15 reaches via lines (not illustrated) the work connector A. From here the hydraulic medium reaches via a bore 30 in the engine block 29 the cylinder chamber 31 in which a transmission piston 32 is moveably arranged. The piston 32 is moved upwardly (FIG. 4) by the hydraulic medium. The end of the piston rod of the piston 32 which projects upwardly past the cylinder chamber 31 is connected by a ball and socket joint to one arm of a transmission element 33 in the form of a two-arm elbow lever 33, and the elbow lever 33 is thus pivoted by the upwardly moving piston 32 in the clockwise direction. The elbow lever 33 is supported on a cam-shaped adjusting device 39. By means of the elbow lever 33 the valve shaft 21 is moved downwardly against the force of the coil pressure spring 18 so that the valve disc 22 is lifted off the seat and the intake opening 23 is opened. The valve shaft 21 is moveably arranged in a slide bushing 34 which is mounted in a bore 35 of the engine block 29. On the upper end of the valve shaft 21 a spring plate 36 is arranged on which the coil pressure spring 18 is supported with one end. The other end of the spring 18 rests against the bottom 37 of a depression or recess 38 of a transverse wall 40 of the engine block 29. The transverse wall 40 delimits a receptacle 41 in which the elbow lever 33 is arranged and in which the valve shaft 21 with the spring plate 36 as well as the piston rod carrying the piston 32 are positioned. The piston 32 and the cylinder chamber 31 are arranged in a cylinder 42 which is arranged in a receptacle 43 in the transverse wall 40 of the engine block 29.

With the cam-shaped adjusting device 39, a sensitive adjustment of the position of the intake/exhaust valve is possible. It is advantageously possible to control this cam-shaped adjusting device 39 in a targeted way during operation in order to achieve a stroke change of the intake/exhaust valve 21, 22 in this way.

By means of the adjusting device 39, preferably in the form of a camshaft, overlaid control actions or governing actions of the engine can be performed. In an advantageous way, a delayed or advanced opening or closing of the intake and exhaust valves is possible.

Figure 5:
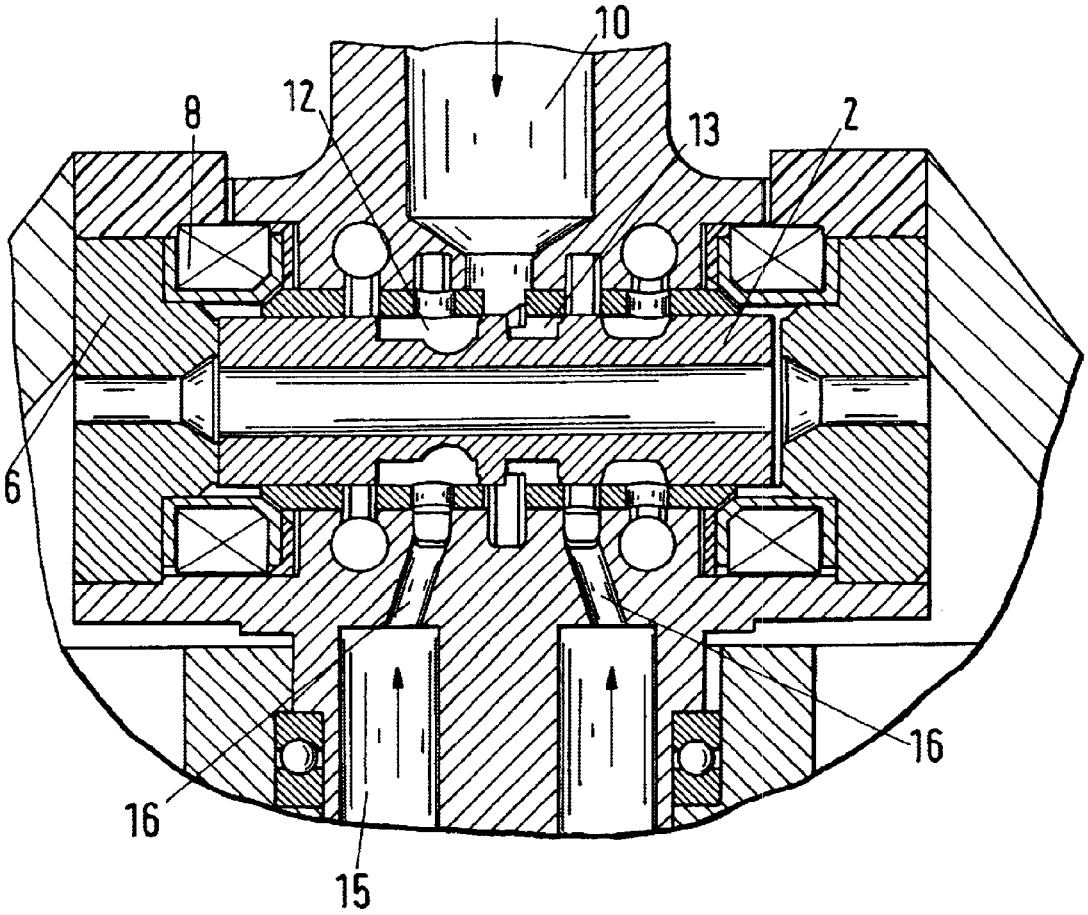
FIG. 5 shows on an enlarged scale and in axial section a control valve of the control device of FIG. 3 according to the invention in a first end position of the control valve piston.

In the position of the control valve piston 2 according to FIG. 5, the pressure medium is introduced via the pressure line 10 into the annular groove 13 which is closed relative to the pressure chamber 15. The annular groove 12 is relieved to the tank T so that the hydraulic medium can flow from the pressure chamber 15 in the direction of the illustrated arrows via the bores 16 back to the tank. In this position the control valve piston 2 rests against the stop 6. The control valve piston 2 in this end position is secured by residual magnetism so that current supply to (excitation of) the coil 8 is not required in this switching position.

Figure 6:
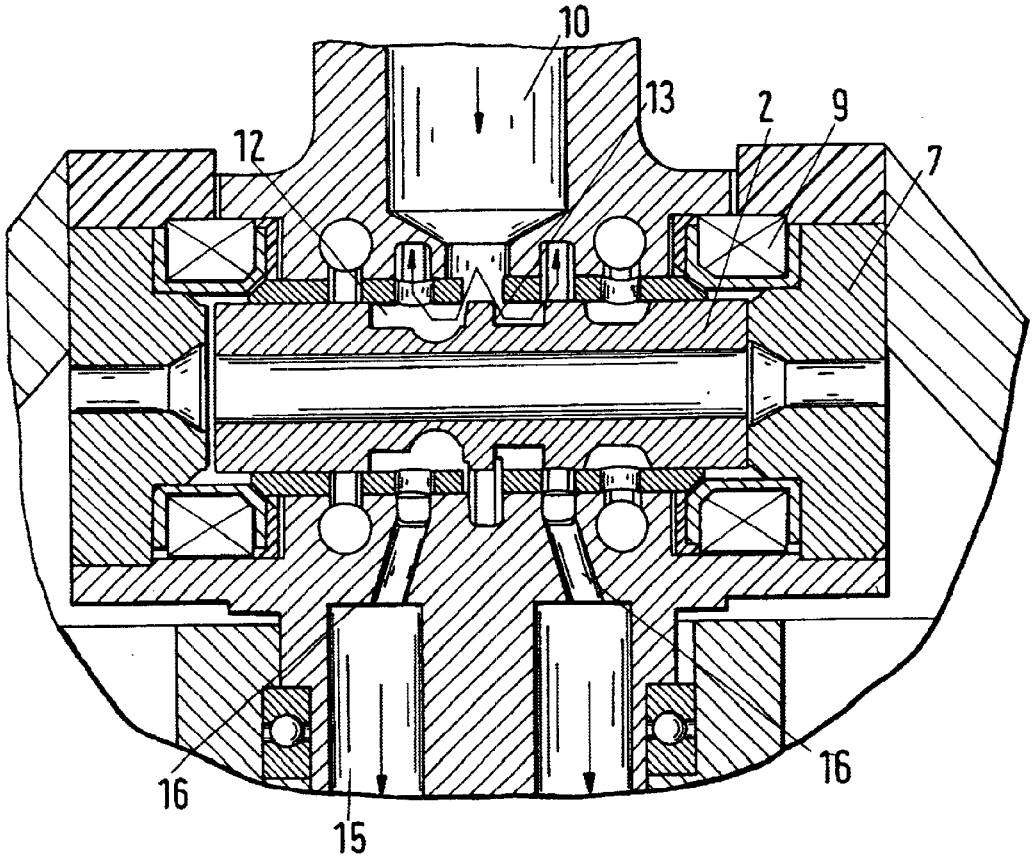
FIG. 6 shows on an enlarged scale and in axial section a control valve of the control device according to the invention of FIG. 3 in a second end position of the control valve piston.

FIG. 6 shows the control valve piston 2 in the other switching position in which it rests against the stop 7. In this position the control valve piston 2 is also secured by residual magnetism so that the coil 9 must not be supplied with current in order to secure the control valve piston 2 in this position. The pressurized hydraulic medium is conveyed from the pressure line 10 via the annular grooves 12, 13 and the bores 16 into the pressure chamber 15. The hydraulic medium thus moves the bucket tappet 17 (FIG. 1) in the described way.

Figure 7:
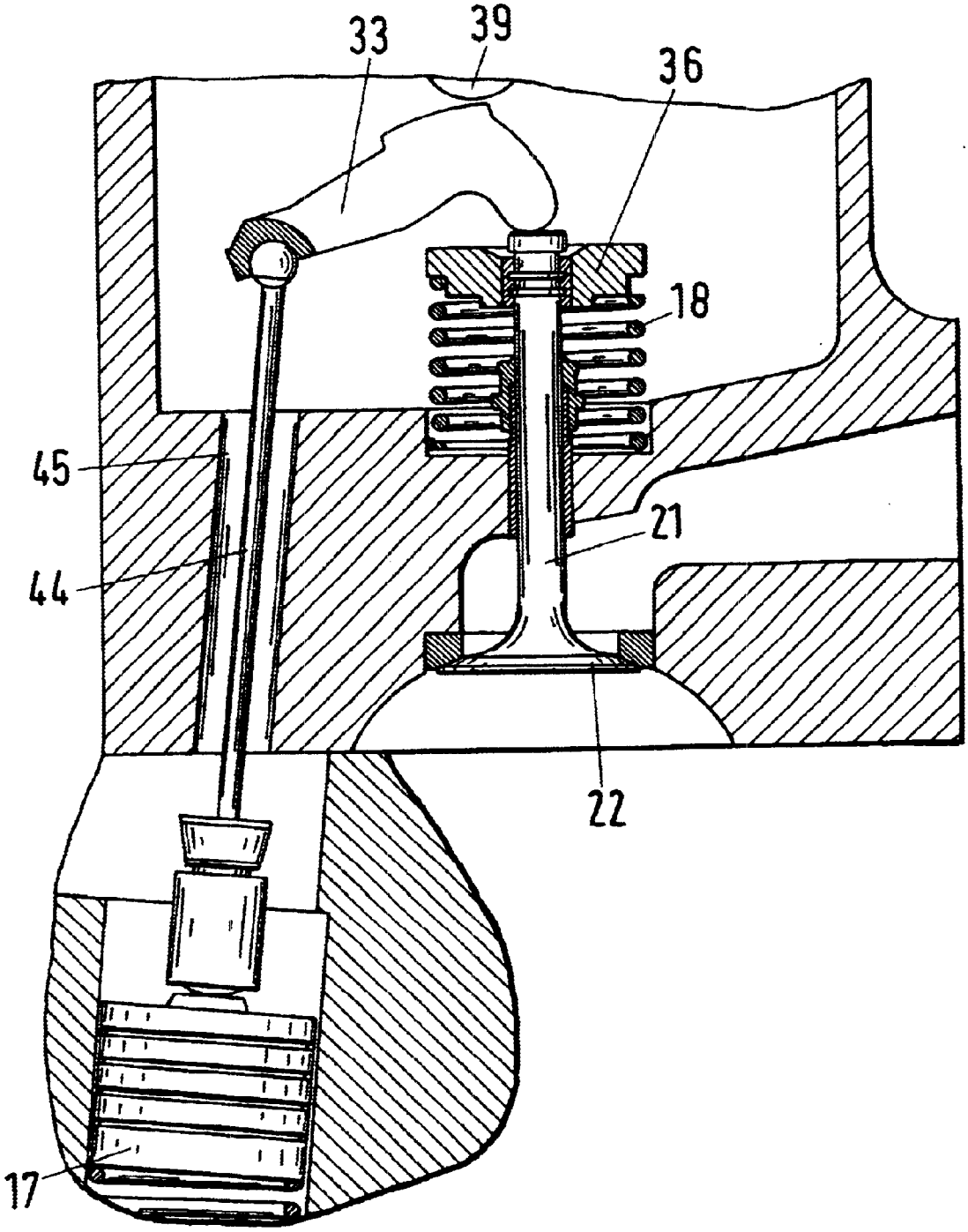
FIG. 7 is an axial section of a third embodiment of the control device according to the invention.

In the embodiment according to FIG. 7, the bucket tappet 17 is arranged in the area below and adjacent to the valve shaft 21 with the valve disc 22. The bucket tappet 17 is connected to an axle 44 which projects with play through a through opening 45 and has one arm of a transmisison element 33 in the form of an elbow lever 33 supported on its free end by means of a ball and socket joint. The other arm of the elbow lever 33 is positioned according to the embodiment of FIG. 4 at the upper end of the valve shaft 21 which at the upper end is provided with a spring plate 36 on which the coil pressure spring 18 is supported. By means of the coil pressure spring 18 the valve plate 22 is pulled into its closed position. The control device according to FIG. 7 operates in other respects in the same way as the embodiment according to FIG. 4.

Figure 8:
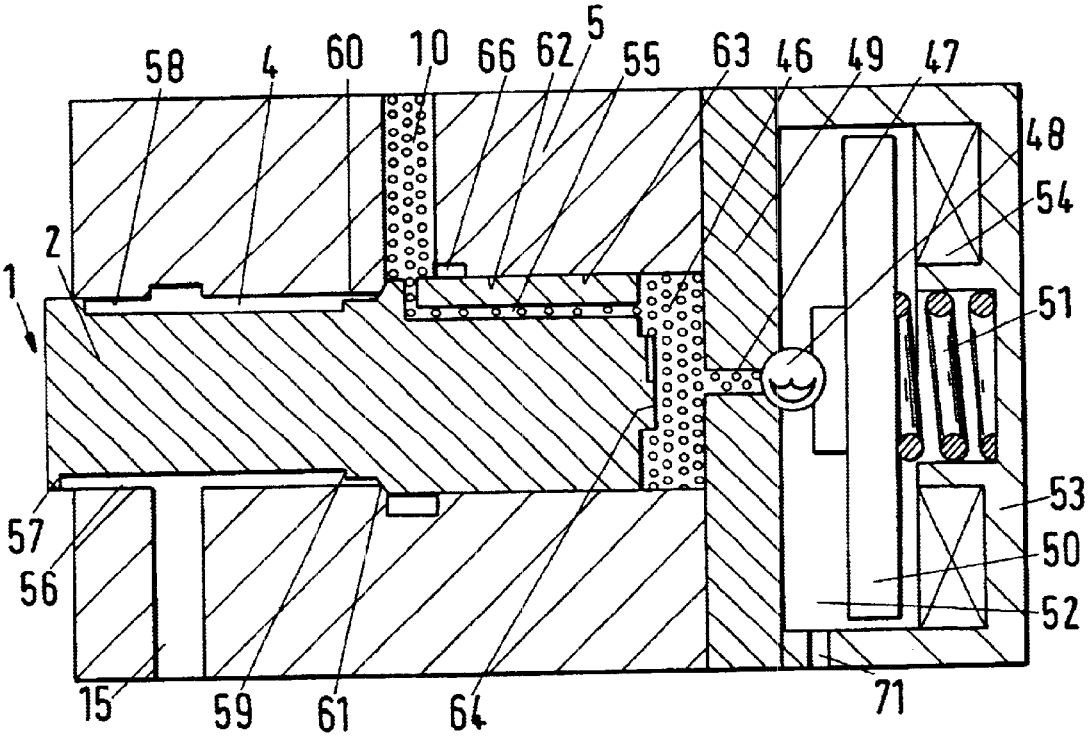
FIG. 8 shows in an axial section and in a schematic illustration a control valve in a position in which the work connector is connected with the tank connector.
Figure 9:
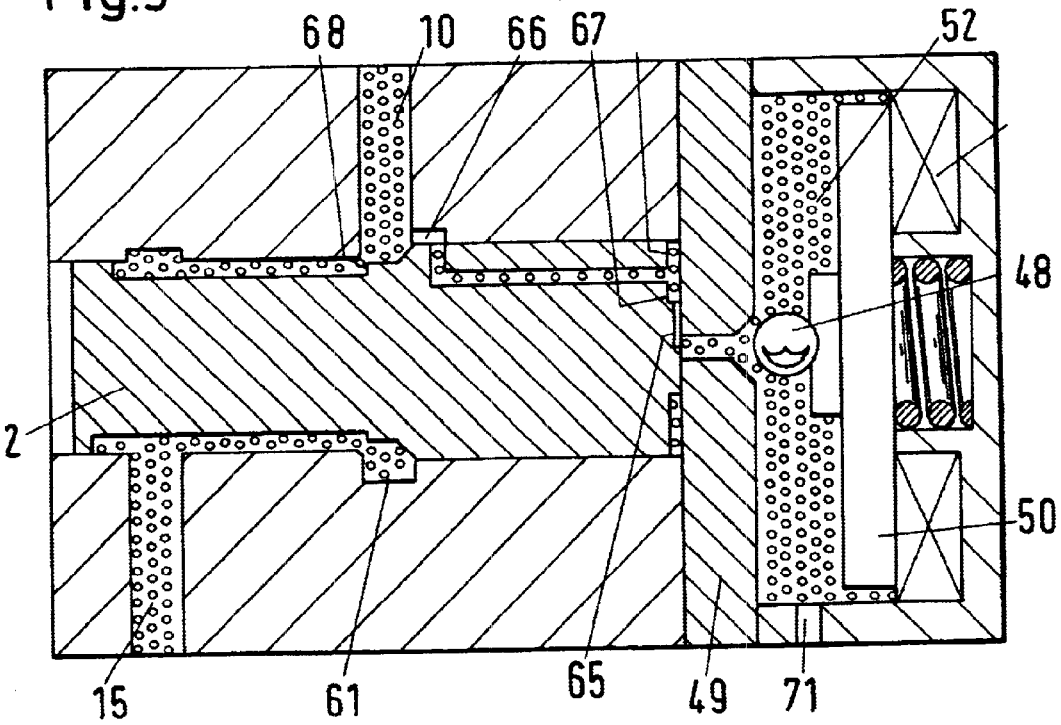
FIG. 9 shows the control valve according to FIG. 8 in a position in which the pressure connector is connected to the work connector.

FIGS. 8 and 9 show a control valve 1 with a control valve piston 2 which delimits one side of a pressure chamber 46 into which a bore 47 opens which is closed by a valve element 48, such as a valve ball. The pressure chamber 46 is delimited by a housing wall 49 in which the bore 47 is provided. The valve element 48 is secured by the armature element or base plate 50 in a closed position, as illustrated in FIG. 8. The armature base plate 50 is subjected to the force of at least one pressure spring 51 which is arranged in a receptacle 52 of the valve housing 5. The receptacle 52 is delimited at one side by the housing wall 49. Advantageously, the receptacle 52 is delimited by a removable hood-shaped lid 53 which is fastened with its edge on the housing wall 49. In the lid 53 a coil 54 is arranged which, when excited, pulls the armature base plate 50 against the force of the pressure spring 51 toward it. The lid 53 is provided with at least one bore 71 opening into the receptacle chamber 52 via which a pressure-less outflow of the control oil present in the receptacle 52 is possible.

The control valve piston 2 is provided with a supply line in the form of a bore 55 which connects the pressure line 10 with the pressure chamber 46 when the valve, comprised of the bore 47 and the valve element 4, is closed. The cross-section of the bore 55 is smaller than the cross-section of the bore 47 which is closed by the valve element 48.

The control valve piston 2 is provided with an annular chamber 56 in its mantle surface which is connected with the pressure chamber 15 in any position of the control valve piston 2. The pressure chamber 56 is delimited at the end facing away from the pressure chamber 46 by a collar 57 with which the control valve piston 2 rests against the inner wall 58 of the receptacle 4 of the valve housing 5. The annular chamber 46 is delimited at the axial other end by a collar 59 which has a smaller outer diameter than the receptacle 4. The cylindrical mantle surface 60 of the collar 59 has a transition by means of a conical surface 61 into a cylindrical mantle surface 62 with which the control valve piston 2 rests against the inner wall 63 of an area of the receptacle 4 having a greater diameter.

At the end face facing the bore 47 the control valve piston 2 is provided with a central projection 64 in which a throttle 65 is provided which is formed by a radial depression. When the valve is open (FIG. 9), the throttle 65 connects the bore 47 with the pressure chamber 46.

When the valve is closed, the annular chamber 56 of the control valve piston 2 is relieved in the direction toward the tank so that the hydraulic medium can return from the pressure chamber 15 via the annular chamber 56 to the tank. The receptacle 52 arranged between the armature base plate 50 and the housing wall 49 is also relieved to the tank.

When the internal combustion engine is to be provided with a fuel/air mixture charge, the coil 54 is supplied with current. The anchor base plate 50 is pulled toward the coil 54 against the force of the pressure spring 51. The valve element 48 is moved by the force of the hydraulic medium present within the pressure chamber 46 into the open position (FIG. 9) so that the hydraulic medium can flow out of the pressure chamber 46 via the bore 47 into the receptacle 52 which is closed relative to the tank in the position according to FIG. 9. The control valve piston 2 is moved to the right as a result of the surface area ratios loaded by the hydraulic medium until it rests against the housing wall 49. This has the result that first the annular chamber 56 is closed relative to the tank. Subsequently, the connection between the pressure line 10 and the pressure chamber 15 is opened by the conical surface 61 of the control valve piston 2 so that the pressurized hydraulic medium then can flow in the manner described in the preceding embodiments to the pressure chamber 15 in order to thus move the bucket tappet 17 in the way described above and to thereby open the intake/exhaust valve 21, 22.

The bore 47 in the housing wall 49 has a greater flow cross-section than the bore 55 in the control valve piston 2. This ensures that the hydraulic medium in the pressure chamber 46 in front of the control valve piston 2 can flow out faster via the bore 47 than the hydraulic medium can flow into the pressure chamber 46 via the pressure line 10 and the bore 55. Accordingly, the pressure in the pressure chamber 46 in front of the control valve piston 2 will drop toward zero so that the control valve piston 2 can be moved into the release position according to FIG. 9 as a result of the surface area differences.

The control valve piston 2 is positioned with its cylindrical mantle surface 62 at the inner wall 63 of the portion of the receptacle 4 having a greater diameter.

In the end position of the control valve piston 2 illustrated in FIG. 9, the depression or recess 65 provides a connection between the bore 47 in the housing wall 49 and the bore 55 in the control valve piston 2. The pressure line 10 is connected at the radial inner end to an annular channel 66 which is provided in the inner wall 63 of the receptacle 4. This annular channel 66 is of such an axial length that in the end position of the control valve piston 2 according to FIG. 9 the bore 55 is in communication with the annular channel 66.

When the coil 54 is no longer supplied with current, the armature base plate 50 is moved by the pressure spring 51 in the direction toward the housing wall 49.

Accordingly, the valve element 48 is moved into its closed position in which it closes the bore 47 in the housing wall 49 relative to the receptacle 52. The annular surface 67 surrounding the projection 64 of the control valve piston 2 has a larger surface area than a radially positioned annular surface 68 of the collar 59 of the control valve piston 2. Accordingly, the pressure of the hydraulic medium flowing from the pressure line 10 to the pressure chamber 15 and acting on the annular surface 68 is smaller than the pressure exerted by the pressure medium onto the annular surface 67. The control valve piston 2 is thus reliably moved back into the initial position according to FIG. 8. When this occurs, first the pressure line 10 is closed by the conical surface 61 of the control valve piston 2. Subsequently, the annular chamber 56 is relieved in the direction to the tank. This temporal sequence is achieved by overlap of the conical surface 61 with a corresponding edge of the pressure line 10.

The throttle 65 in the projection 64 of the control valve piston 2 ensures that the control valve piston 2 can be reliably returned from its contact position at the housing wall 49. The flow cross-section of the throttle 65 is larger than the flow cross-section of the annular channel 66. This ensures that upon closing of the valve element 48 a sufficiently high pressure is built up in the pressure chamber 46 before the control valve piston 2 in order to move the piston 2 back in the described way.

The control valve 1 according to FIGS. 8 and 9 enables a very quick switching. For example, the control valve piston 2 requires for its complete stroke a switching time of less than 200 $\mu$s. The valve comprised of bore 47, valve element 48 and acting as a pilot valve is also suitable for piston valves with solenoids corresponding to the preceding embodiments. It is moreover possible to actuate the pilot valve (47, 48) also with piezoelectric or magnetorestrictive, actively operated valves. The return element for the valve element 48 can also be a tube spring or any other type of spring of a suitable configuration.

The armature base plate 50 is formed as a flat armature with which very high forces and high accelerations can be achieved.

Figure 11:
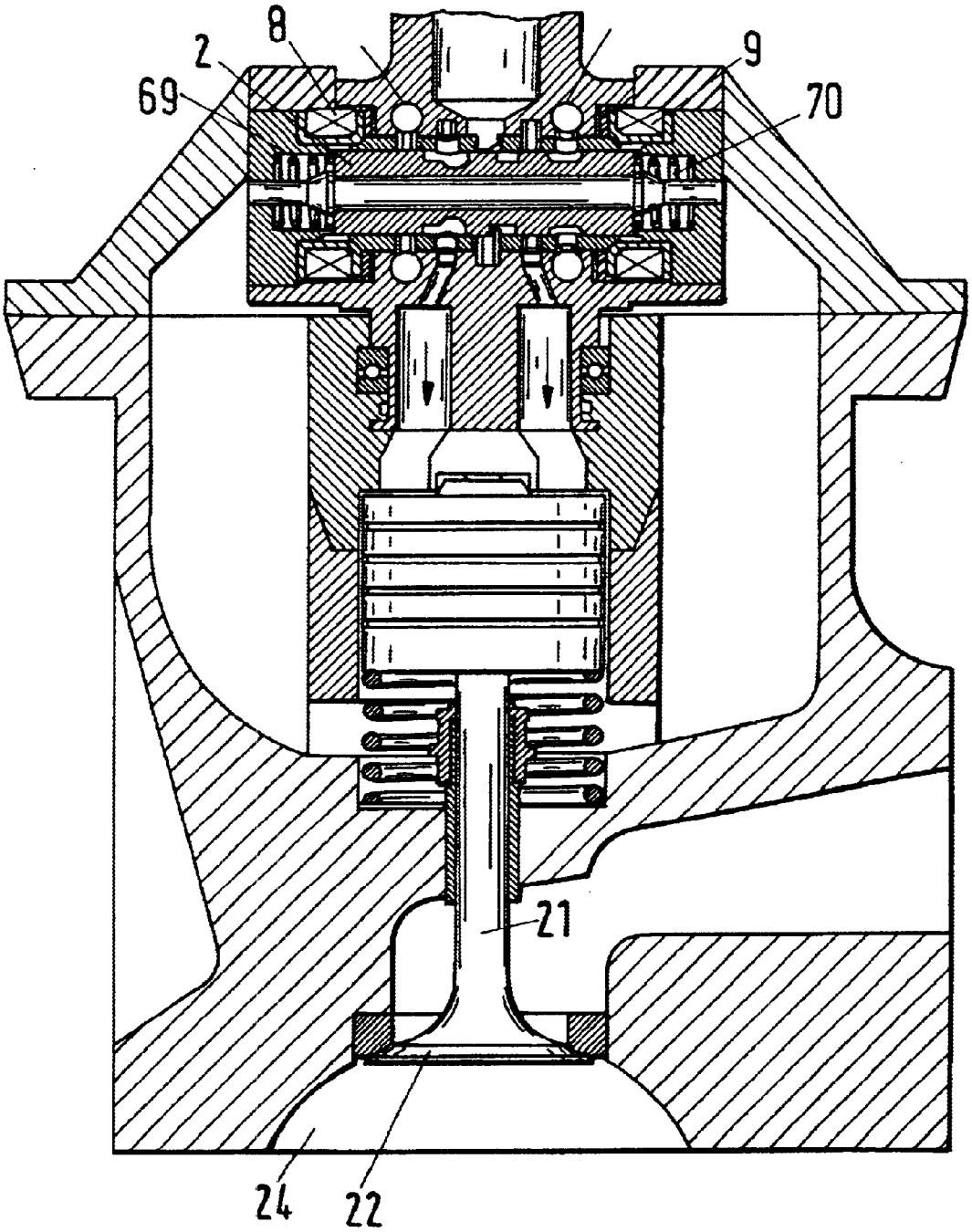
FIG. 11 shows an axial cross-section of a fourth embodiment of the control device according to the invention.

FIG. 11 shows an embodiment which is substantially identical to the embodiment according to FIG. 1. The control valve piston 2 is loaded at both ends with a pressure spring 69, 70, respectively, so that the control valve piston 2 assumes a central position when the corresponding coils 8, 9 are not excited. This defined central position of the control valve piston 2 ensures that the intake/exhaust valve 21, 22 will not completely open but will assume a central position so that a correspondingly smaller amount of air/fuel mixture is conveyed into the combustion chamber 24. In order to reach this central position, first one coil 8 or 9 is supplied with current in the way described above so that the control valve piston 2 is moved in the corresponding direction. As soon as the desired smaller opening cross-section has been reached, the current supply of this coil is terminated so that the control valve piston 2 is secured in the central position by the two pressure springs 69, 70. Accordingly, the intake/exhaust valve 21, 22 remains in its central position. In this way, the intake/exhaust valve 21, 22 can be moved into three positions, i.e., a closed position, a half-open position, and a completely open position.

Instead of the coils 8, 9 to be supplied with current, the actuating elements for the control valve piston 2 can be, for example, piezoelectric actuators or piezoelectric elements. It is also possible to employ magnetorestrictive switching elements.

The bushing 3 of the different embodiments in which the control valve piston 2 is slidably supported is not necessarily required.

In order to improve the switching movement of the control valve piston 2, it is possible, for example, in the embodiment according to FIG. 1, to provide a permanent magnet in addition to the solenoid with the coil 8. In this configuration the control valve piston 2 is secured in the respective end position by the magnetic force of this permanent magnet when the coil 8 is not supplied with current. This coil is configured such that the magnetic field resulting when it is excited cancels the magnetic field of the permanent magnet. In order to be able to move the control valve piston 2 quickly, both coils 8, 9 are supplied with current. Since the excitation of the coil 8 cancels the magnetic field of the permanent magnet, the control valve piston 2 is quickly pulled because at the opposite side a counter force which would otherwise be provided by the permanent magnet is not present.

In the embodiment according to FIG. 11, the position of the control valve piston 2 when the coils 8 and 9 are not excited can be adjusted, on the one hand, and the acceleration of the control valve piston 2 and thus its switching behavior can be affected, on the other hand, by the proper selection of the two pressure springs 69, 70. As a result of this arrangement, an optimized configuration of the control valve or of the entire actuating device for the intake/exhaust valve 21, 22 can be provided.

The switching behavior described with the above embodiments can be used for different purposes, for example, for an injection device of an internal combustion engine of a motor vehicle.

As a result of the described configuration, very high acceleration values can be obtained with the control valve piston 2. For example, the control valve piston 2 can be moved, for example, with a speed of approximately 400 $\mu$s from one into the other switching position. When the control valve piston 2 is loaded additionally by the pressure springs 69, 70, the switching velocity can be increased even more.

For the described control devices an electronic control is used which sets the switching cycles. The electronic control enables in connection with the control devices completely new possibilities of motor control, such as cylinder turn-off or the optimization of idle operation of the engine and of the fuel consumption. Also, closing or partial opening of the valves can be used for controlling the engine brake function. The combustion process can be optimized by controlling the fuel/air mixture supply and thus the pollutant emissions can be improved. As a result of the described active control of the control devices quiet running properties of the engine are considerably improved.

Possible valve discontinuities can be compensated by electronic devices and software. The start-up and/or the stopping behavior of the control valve piston 2 can be optimized by linearizing the piston movement. In the control devices with coils 8, 9, the counter inductivity of the inactive coil can be used for determining the actual piston movement (sensor as a feedback) and thus for controlling and governing the control valve piston 2. Also, further coil windings or an additional travel sensor can be employed for controlling and governing the control valve piston 2. The control of the control valve piston 2 allows the realization of partial strokes which provide an exact repetition behavior for precise control of the intake/exhaust valves 21, 22.

The relief bores or tank connectors T are configured such that draining of the hydraulic medium from the control valve piston chamber is prevented. This is achieved, for example, in that a rising line is provided. In this way, it is ensured that the hydraulic medium level (static hydraulic medium level) is above the control valve piston 2 so that ambient air cannot penetrate into the control valve 1. In this way, the precision from switching to switching can be significantly improved. If air were to enter the control valve, it would be compressed so that the switching behavior would deteriorate considerably.

It is also possible to pre-load the return hydraulic medium with pressure in order to maintain the conditions within the control valve 1 constant. In order to maintain pressure within the return hydraulic medium simple pre-loaded plates or seat valves with springs can be used. This also prevents air from entering the control valve 1.

While specific embodiments of the invention have been shown and described in detail to illustrate the inventive principles, it will be understood that the invention may be embodied otherwise without departing from such principles.

What is claimed is:

1. A control device for switching an intake or exhaust valve of an internal combustion engine, the control device comprising:

a control valve comprising a control valve piston configured to control flow of a hydraulic medium from a pressure line to the intake or exhaust valve;

at least one actuating element correlated with the intake or exhaust valve and having a first end acted on by the hydraulic medium;

at least one damping device interacting with the at least one actuating element and arranged at a second end of the actuating element opposite the first end, wherein the at least one damping device is configured to exert a damping force onto the actuating element counteracting a force exerted by the hydraulic medium;

wherein the control valve has a first pressure chamber located at a first end of the control valve piston and a second pressure chamber communicating with the first pressure chamber via a bore, wherein a valve element is provided and has a closing position for closing off the bore.

2. The control device according to claim 1, wherein the damping device comprises at least one pressure spring.

3. The control device according to claim 1, wherein the damping force of the damping device is a hydraulic force.

4. The control device according to claim 3, wherein the damping device comprises at least one supply line for a hydraulic damping medium, wherein the supply line is configured to be closed off by the actuating element when the actuating element moves into an end position.

5. The control device according to claim 4, wherein the actuating element is a bucket tappet.

6. The control device according to claim 1, wherein the control valve piston is configured to be moved electromagnetically.

7. The control device according to claim 6, further comprising a pilot valve configured to actuate the control valve piston.

8. The control device according to claim 7, wherein the pilot valve is a piezoelectric or magnetorestrictive, actively operated valve.

9. The control device according to claim 1, wherein the control valve further comprises a first coil, a second coil, and a valve housing, wherein the first and second coils are arranged in the valve housing in areas where opposed ends of the control valve piston are positioned.

10. The control device according to claim 9, wherein the control valve piston is configured to be secured in a first end position by residual magnetism.

11. The control device according to claim 1, wherein the control valve piston and the actuating element are positioned atop one another and are spaced from one another.

12. The control device according to claim 1, wherein the control valve piston is arranged at a spacing adjacent to the intake or exhaust valve.

13. The control device according to claim 1, wherein the switching valve comprises an armature element configured to secure the valve element in the closing position.

14. The control device according to claim 13, wherein the armature element further comprises a pressure spring acting on the armature element, wherein the armature element is configured to be moved counter to the pressure spring.

15. The control device according to claim 1, wherein the control valve piston has a supply line configured to connect the pressure line to the first pressure chamber.

16. The control device according to claim 15, wherein the control valve piston has an end face delimiting the first pressure chamber and wherein the end face has at least one throttle connecting the first pressure chamber to the supply line of the control valve piston when the end face of the control valve piston contacts an oppositely arranged wall of the pressure chamber.

17. The control device according to claim 15, wherein the control valve piston has an annular channel located at a transition of the supply line to the pressure line.

18. The control device according to claim 16, wherein the end face of the control valve piston delimiting the first pressure chamber is a first annular surface and wherein the control valve piston has a second annular surface facing away from the first annular surface and configured to be loaded by the hydraulic medium supplied via the pressure line, wherein the first annular surface is greater than the second annular surface.

19. The control device according to claim 1, wherein the control valve has at least one magnet configured to secure the control valve piston in at least one end position.

20. The control device according to claim 1, wherein the control valve has at least three switching positions.

21. The control device according to claim 1, further comprising a valve bushing configured to adjust the switching valve.

22. The control device according to claim 1, wherein the control valve further comprises a first coil, a second coil, and a valve housing, wherein the first and second coils have carriers and are secured in the valve housing by welding the carriers to the valve housing in areas where ends of the control valve piston are positioned.

23. A control device for switching an intake or exhaust valve, of an internal combustion engine, the control device comprising:

a control valve comprising a control valve piston configured to control flow of a hydraulic medium from a pressure line to the intake or exhaust valve;

at least one actuating element correlated with the intake or exhaust valve and having a first end acted on by the hydraulic medium;

at least one damping device interacting with the at least one actuating element and arranged at a second end of the actuating element opposite the first end, wherein the at least one damping device is configured to exert a damping force onto the actuating element counteracting a force exerted by the hydraulic medium;

wherein the control valve has relief bores configured such that the control valve piston is surrounded by the hydraulic medium and ambient air cannot penetrate into the control valve.

24. The control device according to claim 23, wherein the hydraulic medium to be returned is pre-loaded.

* * * * *